United States Patent [19]

Fischer et al.

[11] Patent Number: 5,048,489

[45] Date of Patent: Sep. 17, 1991

[54] HYDRAULICALLY OPERATED VALVE WITH CONTROLLED LIFT

[75] Inventors: Christof D. Fischer; Diethard Plohberger; Karl Wojik, all of Graz, Austria

[73] Assignee: Avl Gesellschaft Für Verbrennungskraftmaschinen und Messtechnik M.B.H. Prof.Dr.Dr.h.c. Hans List, Graz, Austria

[21] Appl. No.: 507,453

[22] Filed: Apr. 11, 1990

[30] Foreign Application Priority Data

Apr. 12, 1989 [AT] Austria ..... A865/89

[51] Int. Cl.[5] ..... F02M 49/02; F02M 53/00; F02M 61/16; F02M 67/04

[52] U.S. Cl. ..... 123/467; 123/532; 123/534; 239/456; 239/459; 239/584; 251/285; 251/336; 251/95

[58] Field of Search ..... 123/507, 508, 532, 534, 123/467, 497, 499; 239/456, 459, 584; 251/285, 336, 322, 323, 95, 114

[56] References Cited

U.S. PATENT DOCUMENTS

| | | | |
|---|---|---|---|
| 1,230,536 | 6/1917 | Stoeltzien | 123/532 |
| 1,499,794 | 7/1924 | Wennerby | 123/507 |
| 1,629,633 | 5/1927 | Olsen | 123/532 |
| 1,980,460 | 11/1934 | White | 239/456 |
| 2,968,443 | 1/1961 | Manning | 239/456 |
| 3,043,556 | 7/1962 | Noland | 251/285 |
| 3,134,569 | 5/1964 | Sidenbender et al. | 251/285 |
| 3,363,652 | 1/1968 | James | 251/323 |
| 3,430,650 | 3/1969 | Cain | 251/336 |
| 3,477,693 | 11/1969 | Bezanis | 251/285 |
| 4,300,509 | 11/1981 | Schechter | 123/499 |

FOREIGN PATENT DOCUMENTS

| | | | |
|---|---|---|---|
| 0240868 | 11/1985 | Japan | 123/507 |
| 37336 | 12/1912 | Sweden | 123/531 |

*Primary Examiner*—Carl Stuart Miller
*Assistant Examiner*—Thomas N. Moulis
*Attorney, Agent, or Firm*—Watson, Cole, Grindle & Watson

[57] ABSTRACT

A hydraulically operated valve with controlled lift, in particular a fuel/gas injection valve for internal combustion engines, has a stop face fixed on the valve stem. For accurate control of the opening of the valve a stop cam is provided, which is drivn mechanically via a friction clutch, and which cooperates with the stop face. By rotating the cam through a predetermined angle the maximum valve lift will be obtained. The cam may be brought into contact with the stop face even in the closed position of the valve.

16 Claims, 3 Drawing Sheets

HYDRAULICALLY OPERATED VALVE WITH CONTROLLED LIFT

BACKGROUND OF THE INVENTION

This invention relates to a hydraulically operated valve with controlled lift, in particular a fuel/gas injection valve for internal combustion engines, comprising a stop face that is fixed on the valve stem. With the use of such valves a particularly high thermal efficiency may be achieved in internal combustion engines. At the beginning of the working stroke a defined volume of gas is taken from the respective cylinder and is stored temporarily in a storage cell. The fuel is injected into this temporary storage cell. In this way distribution of the fuel in the stored volume is permitted to last for almost as long as the entire working cycle of the engine. The valve opens during the subsequent compression stroke.

DESCRIPTION OF THE PRIOR ART

Valves are known which have a plunger with a stop face. This stop face cooperates with a counter-face in the valve casing, limiting the maximum valve lift. In order to adjust the injection process to different operating parameters of the engine it has proved necessary and desirable, however, to be able to make adjustable the maximum valve lift.

SUMMARY OF THE INVENTION

It is an object of the invention to avoid the above disadvantages and to provide a valve in which the maximum valve lift may be adjusted precisely to suit specific operating conditions. Differences in thermal expansion, wear, etc., should not affect the accuracy of valve adjustment.

For this reason the invention proposes the use of a stop cam, which is mechanically driven via a friction clutch and which cooperates with the stop face, maximum valve lift being obtained by rotating the stop cam through a defined angle, and contact between the cam and the stop face being obtainable even when the valve is in its closed position. In addition, a control unit is provided for control of the cam drive in accordance with the operational state of the engine.

Thus the valve always has two extreme positions, i.e., one defined by the valve disk sitting in the valve seat, and the other one defined by the stop face having arrived at the stop cam. The stop cam is arranged such that it may be brought into contact with the stop face even when the valve is closed. In this way it is possible for the stop cam to return to an initial position after every working stroke of the valve, in which the cam is in contact with the stop face when the valve is closed.

This will provide a well-defined starting position for the rotatory movement of the stop cam performed for limiting the subsequent opening of the valve. In this manner differences in thermal expansion and wear may be compensated.

Preferably, the stop cam is driven by an electric motor, i.e., preferably a stepping motor. This will ensure a quick response of the adjusting mechanism to the control pulses. Depending on the required accuracy and the specific application an ordinary servo-motor or a stepping motor may be used.

In a multi-cylinder engine the use of a single motor is recommended for actuating several stop cams in the valves of several cylinders. This will simplify the design considerably, doing away with complex components and reducing control expense. In this way all cams are reset and the desired state free from play is achieved at a time when all valves are closed, for example, when the fuel-supply is cut off during the use of the engine brake.

It is of special advantage if the friction clutch is placed in a recess of the stop cam. This will result in a particularly compact design.

Provisions may be made for the driving shaft to penetrate the valve casings, the assemblies consisting of friction clutch and stop cam being placed inside the valve casings. Thus the valve itself serves as a housing for the more sensitive components, i.e., in particular, the friction clutch. Only the driving gear is situated outside of the valves.

It is provided in a preferred variant of the invention that the friction clutch transmit a lesser torque in the direction of rotation causing the stop cam to approach the stop face than in the opposite direction. During the resetting phase the motor will press the cam against the stop face of the closed valve. The force applied during this process will correspond to the torque the friction clutch transmits in closing direction. In order to ensure that the stop cam is released even if it seizes on the stop face due to unfavorable conditions of friction, a higher torque may be required. This torque may be provided by a suitable friction clutch.

Such a clutch must have at least one cheek which is in contact with the inside of a cylindrical surface against which it is pressed by a spring, whereupon the transmitted torque is self-amplified in one direction of rotation due to the fact that the clutch-cheek is held to the driving shaft of the clutch at one of its ends. The friction clutch thus works like a shoe brake.

It is recommended to provide a control unit for the motor, which will utilize given performance characteristics and data on the operational state of the engine to control the maximum valve lift by rotation of the stop cam, and which will effect a reverse rotation of the cam when the valve is closed, during which reverse rotation the rotating angle of the motor is larger than would correspond to the return to the theoretical reset-position. If the motor is configured as a stepping motor the control unit will effect a predetermined number of steps before the opening of the valve, corresponding to a given rotating angle of the stop cam and thus a given maximum valve lift, and it will further initiate a number of steps to be taken in opposite direction after the closing of the valve, which is larger than the one before the opening of the valve. This will ensure that the stop cam will press against the stop face without any play, even if there are dimensional changes due to wear or thermal loads. The excess movement of the motor is taken up by the friction clutch. Basically, such a resetting process may take place during each working cycle. It will suffice, however, to perform this process occasionally, for instance, when the fuel-supply is cut off during the use of the engine brake.

It is recommended to close the valve by means of a hydraulic plunger, preferably actuated by the fuel, which acts against the force of a spring. This will permit a particularly simple design of the device.

Further simplification is achieved by making one surface of the hydraulic plunger serve as a stop face at the same time.

In a special variant of the invention a gas storage cell is provided for a volume of gas taken from the cylinder of an internal combustion engine, as well as a fuel injection device for feeding the fuel into this gas storage cell. With this type of fuel/gas injection valve maximum thermal efficiency may be achieved in an internal combustion engine.

It may further be provided that the valve be thermally insulated vis-a-vis the cylinder head of the engine. In this way the temperature of the valve is increased considerably, which will prevent the formation of carbon deposits and encourage self-cleaning.

It is a special advantage if the maximum valve lift is limited by the stop cam to a value between 0 and 0.5 mm.

BRIEF DESCRIPTION OF THE DRAWINGS

The present invention will be further described by way of example only with reference to the accompanying drawings, in which.

DETAILED DESCRIPTION OF THE PREFERRED EMBODIMENT

Figure 1:
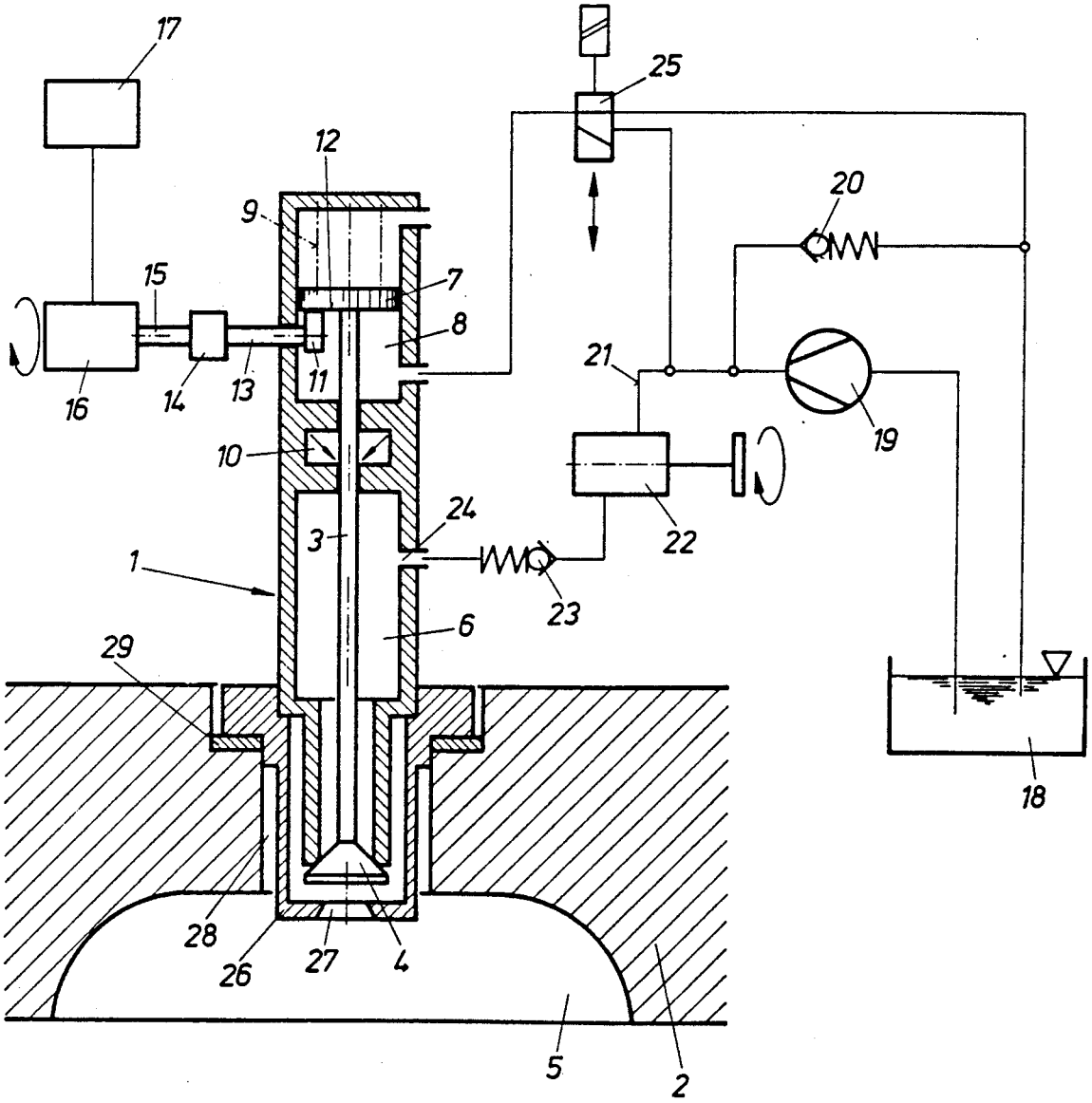
FIG. 1 is a schematical view of a valve as proposed by the invention, presented as a section.

FIG. 1 shows a fuel/gas injection valve 1 located in the cylinder head 2 of an internal combustion engine not shown here in detail. The valve stem 3, which is axially moveable, has a valve disk 4 on its end, closing off the opening between the combustion chamber 5 and the mixer chamber 6 inside the valve 1. A hydraulic plunger 7 is permanently attached to the valve stem 3, sealing a control chamber 8 in the valve 1. The hydraulic plunger 7 is acted upon by a pressure spring 9, which is used to shift the valve 1 into its open position. The mixer chamber 6 and the control chamber 8 are separated by a seal 10.

The lift of the valve 1 is limited by a stop cam 11. This cam 11 cooperates with a stop face 12 located on the hydraulic plunger 7. Via a shaft 13 the cam 11 is in contact with a friction clutch 14 driven by an electric stepping motor 16 via another shaft 15. The stop cam 11 is located such that it may be brought into contact with the stop face 12 even when the valve 1 is in its closed position.

Before the valve 1 opens, a control unit 17 will give a control command to the stepping motor 16, which will then perform a number of steps corresponding to the desired opening of the valve 1.

Operation of the valve is as follows. An amount of fuel is taken from a tank 18 with the use of a feed pump 19. A pressure control valve 20 will maintain constant pressure in the fuel line 21. In a metering unit 22 of a known type, which is supplied from the line 21, the fuel volume is metered for injection. Via a check valve 23 with a slight pre-load and a nozzle 24 the fuel is injected into the mixer chamber 6. The check valve 23 is located as close as possible to the valve 1, in order to minimize evaporation losses. Fuel injection takes place as soon as the valve 1 has closed. At this time the pressure in the mixer chamber 6 is 2-20 bar. The corresponding cylinder of the internal combustion engine is performing its working stroke.

The valve 1 opens during the compression stroke. By that time the injected fuel will have completely evaporated and been uniformly distributed in the mixer chamber 6. Before the opening of the valve the stop cam 11 is brought into the position described above, i.e. limiting the valve lift. Opening is affected via a solenoid-controlled three-way valve 25, which switches to depressurize the control chamber 8 filled with fuel. The pressure spring 9 pushes the hydraulic plunger 7 downwards, until the stop face 12 touches the stop cam 11. At this time the pressure in the combustion chamber 5 is lower than in the mixer chamber 6, and the content of the mixer chamber 6 will flow into the combustion chamber 5. The valve 1 will remain open until after the beginning of the working stroke, and gases from the combustion chamber 5 will flow back again into the mixer chamber 6. The time of closing of the valve 1 is chosen such that the pressure in the mixer chamber 6 is sufficiently high for the next injection (2-20 bar), while the flame front is reliably prevented from entering the mixer chamber 6. The closing of valve 1 is effected by another switch of the three-way valve 25, whereby pressurized fuel from the line 21 is forced into the control chamber 8. The hydraulic plunger 7 moves upwards, closing the valve 1 against the force of the pressure spring 9.

When the fuel mixture is injected into the combustion chamber 5 it is distributed best if an atomizing device 26 is provided for diffusion of the gas jet, with one or more holes 27. In order to prevent the formation of carbon deposits the valve 1 is thermally insulated against the cylinder head 2. Oil carbon mainly forms in a temperature range of 150°–180° C. If the valve is operated above 180° C. it becomes self-cleaning, which will extend its working life considerably. This is facilitated by providing a gap 28 between the valve 1 and the cylinder head 2. Besides, the sealing 29 between valve and cylinder head 2 may be made of material with extremely poor thermal conductivity.

Figure 2:
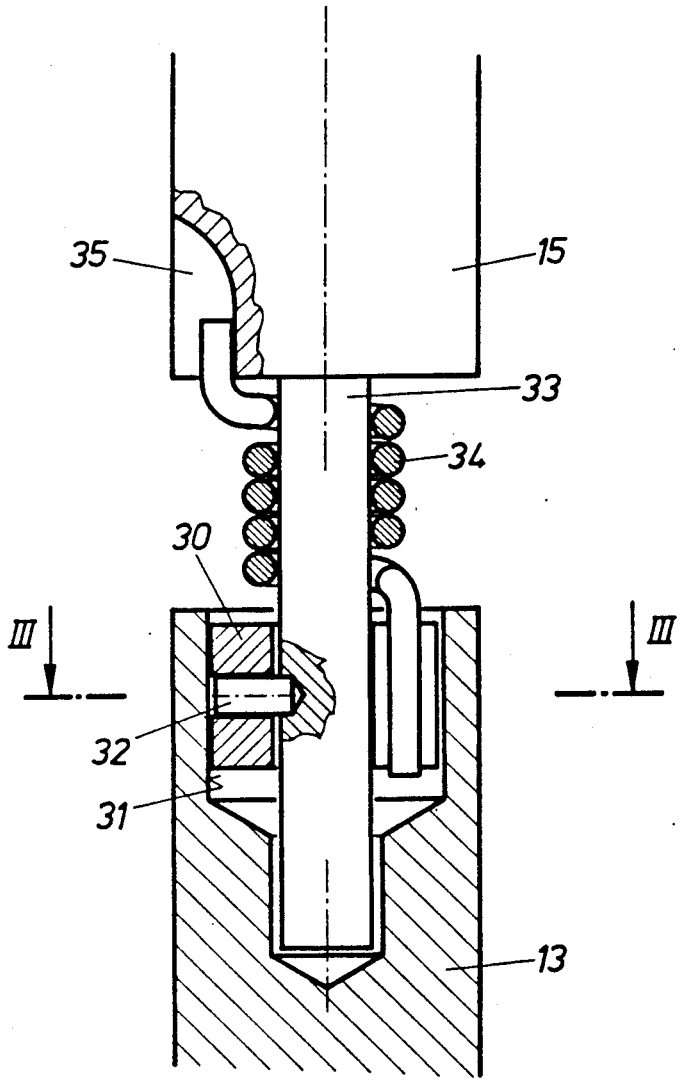
FIG. 2 gives a section of a friction clutch.
Figure 3:
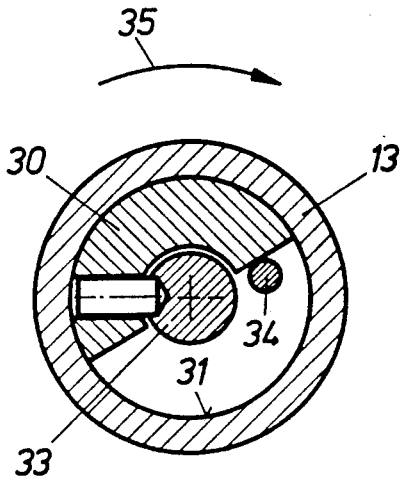
FIG. 3 is a section along line III—III in FIG. 2.

The friction clutch 14 shown in FIGS. 2 and 3 has a cheek 30 which is in contact with the inside of a cylindrical surface 31 worked into the shaft 13. The cheek 30 is attached to a part 33 of the shaft 15 by means of a pin 32. A helical spring 34, which is held in a recess 35 of the shaft 15, presses the cheek 30 against the cylindrical surface 31. The pin 32 and the helical spring 34 act upon opposite ends of the cheek 30 of the clutch 14. In this way it is possible to transmit different torques via the friction clutch 14, which will vary with the sense of rotation of the shaft 15. If the shaft 15 is driven in the direction of the arrow 36, the cheek 30 is pressed against the cylindrical surface 31 by the pin 32 and the helical spring 34, with a force that increases with the transmitted torque. As a result of this self-amplification comparatively large torques may be transmitted. The sense of direction indicated by the arrow 36 corresponds to the movement of the stop cam 11 away from the stop face 12. On the other hand the cheek 30 is pulled away from the cylinder face 31 if the shaft 15 is turned in the opposite direction, and the transmitted torque is considerably smaller.

Figure 4:
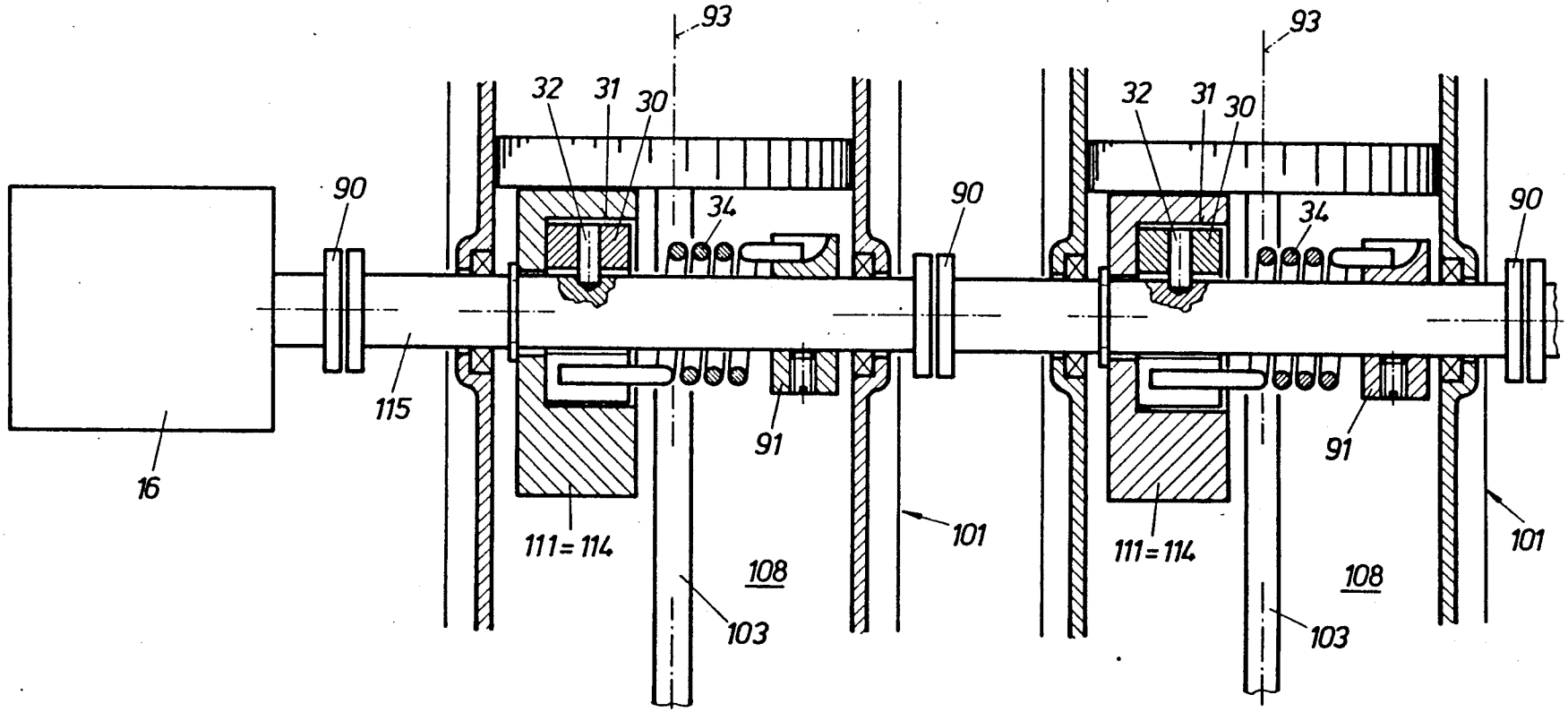
FIG. 4 is a schematical view of a variant of the invention with a common valve drive in a multi-cylinder engine.

In the variant of the invention shown in FIG. 4 a joint motor 16 is provided for driving several stop cams 114 of an internal combustion engine not shown here. The driving shaft 115 penetrates the valve casings 101 in the area of the control chambers 108. The driving shaft 115 consists of several sections connected by flanges 90. The stop cam 111 is constituted by the outer contour of the friction clutch 114. Inside this stop cam 111 a cylindrical surface 31 is provided, against which is pressed the clutch cheek 30. The clutch cheek 30 is attached to the shaft 115 by means of a pin 32. A helical spring 34, which is held in a ring 91 screw-fastened on the shaft 115, presses the cheek 30 against the cylindrical surface 31. The axis 92 of the shaft 115 is situated outside of the plane formed by the axes 93 of the valves 101, such that the valve stem 103 and the driving shaft 115 do not intersect.

We claim:

1. A hydraulically operated fuel/gas injection valve for an internal combustion engine with controlled lift, having a valve stem and a stop face fixed on said valve stem, wherein a stop cam is provided which is mechanically driven via a friction clutch and which cooperates with said stop face, maximum valve lift of said injection valve being set by rotating said stop cam through a defined angle, said stop cam being capable of contacting said stop face when said injection valve is in a closed position, and wherein a control unit is provided for control of a cam drive in accordance with an operational state of said internal combustion engine.

2. A valve according to claim 1, wherein said cam drive for driving said stop cam is a stepping motor.

3. A valve according to claim 2, wherein said control unit of said stepping motor controls the maximum valve lift by rotation of said stop cam, and which effects a reverse rotation of said stop cam when said injection valve is closed, during which reverse rotation the rotating angle of said motor is larger than would correspond to the return to the theoretical reset-position.

4. A valve according to claim 1, for a multi-cylinder engine, wherein a single motor is provided for actuating several of said stop cams of said injection valves of said multi-cylinder engine.

5. A valve according to claim 1, wherein said friction clutch is placed in a recess of said stop cam.

6. A valve according to claim 5, with at least one valve casing and a driving shaft for driving at least one of said stop cams, wherein said driving shaft penetrates said valve casings and assemblies consisting of said friction clutch and said stop cam being placed inside said valve casings.

7. A valve according to claim 6, wherein said friction clutch transmits a lesser torque in the direction of rotation causing said stop cam to approach said stop face than in the opposite direction.

8. A valve according to claim 6, wherein the maximum valve lift is limited by said stop cam to a value between 0 and 0.5 mm.

9. A valve according to claim 1, wherein said friction clutch transmits a lesser torque in the direction of rotation causing said stop cam to approach said stop face than in the opposite direction.

10. A valve according to claim 9, wherein the friction clutch has at least one clutch cheek which is in contact with the inside of a cylindrical surface of said recess of said stop cam, against said cylindrical surface said clutch cheek is pressed by a spring, where the transmitted torque is self-amplified in one direction of rotation due to the fact that said clutch cheek is held to said driving shaft of said clutch at one of its ends.

11. A valve according to claim 10, wherein the maximum valve lift is limited by said stop cam to a value between 0 and 0.5 mm.

12. A valve according to claim 1, wherein said injection valve is closed by means of a hydraulic, fuel-actuated plunger, which acts against the force of a spring.

13. A valve according to claim 12, wherein a surface of said hydraulic plunger serves as said stop face.

14. A valve according to claim 1, wherein a gas storage cell is provided for a volume of gas taken from the cylinder of said internal combustion engine, and wherein a fuel injection device is provided for feeding fuel into said gas storage cell.

15. A valve according to claim 14, wherein said injection valve is thermally insulated against the cylinder head of said internal combustion engine.

16. A valve according to claim 1, wherein the maximum valve lift is limited by said stop cam to a value between 0 and 0.5 mm.

* * * * *